US009427968B2

(12) United States Patent
Kohda et al.

(10) Patent No.: US 9,427,968 B2
(45) Date of Patent: Aug. 30, 2016

(54) LIQUID DISCHARGE HEAD AND IMAGE FORMING APPARATUS

(71) Applicants: Tomohiko Kohda, Ibaraki (JP); Takeshi Shimizu, Kanagawa (JP); Ryo Kasahara, Kanagawa (JP); Kanshi Abe, Ibaraki (JP); Takayuki Nakai, Kanagawa (JP); Takahiro Yoshida, Ibaraki (JP); Shiomi Andou, Kanagawa (JP)

(72) Inventors: Tomohiko Kohda, Ibaraki (JP); Takeshi Shimizu, Kanagawa (JP); Ryo Kasahara, Kanagawa (JP); Kanshi Abe, Ibaraki (JP); Takayuki Nakai, Kanagawa (JP); Takahiro Yoshida, Ibaraki (JP); Shiomi Andou, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/849,869

(22) Filed: Sep. 10, 2015

(65) Prior Publication Data

US 2016/0082728 A1 Mar. 24, 2016

(30) Foreign Application Priority Data

Sep. 18, 2014 (JP) ..... 2014-189543

(51) Int. Cl.
*B41J 2/14* (2006.01)

(52) U.S. Cl.
CPC ..... *B41J 2/1433* (2013.01)

(58) Field of Classification Search
CPC .... B41J 2/1433; B41J 2/1607; B41J 2/1618; B41J 2/1621; B41J 2/1623; B41J 2/14274; B41J 2/162; B41J 2002/14362
USPC ..... 347/47
See application file for complete search history.

(56) References Cited

U.S. PATENT DOCUMENTS

| | | | | |
|---|---|---|---|---|
| 8,888,260 | B2 | 11/2014 | Hayashi et al. | |
| 9,050,803 | B2 | 6/2015 | Koda | |
| 2002/0135643 | A1* | 9/2002 | Sarojiniamma | B41J 2/14209 347/68 |
| 2003/0122902 | A1* | 7/2003 | Sakaida | B41J 2/14209 347/68 |
| 2014/0085380 | A1* | 3/2014 | Uno | B41J 2/14233 347/45 |

FOREIGN PATENT DOCUMENTS

| | | |
|---|---|---|
| JP | H05-330065 | 12/1993 |
| JP | H06-183000 | 7/1994 |
| JP | 2014-054816 | 3/2014 |

* cited by examiner

*Primary Examiner* — Geoffrey Mruk
*Assistant Examiner* — Scott A Richmond
(74) *Attorney, Agent, or Firm* — Cooper & Dunham LLP

(57) ABSTRACT

A liquid discharge head includes a nozzle plate having nozzles arrayed to discharge liquid droplets; a passage plate to form individual liquid chambers communicating with the respective nozzles; and a wall surface member to form a wall surface of the individual liquid chambers. The passage plate is formed with at least three plate-shaped members stacked and bonded by an adhesive. The nozzle plate and one plate-shaped member, and another plate-shaped member and the wall surface member are bonded, respectively. The three plate-shaped members include separation wall parts forming separation walls between the individual liquid chambers. At least one of the three plate-shaped members has a separation wall width different from that of the others, to have fillets of the forced-out adhesive formed between the wall surfaces, and surfaces of the plate-shaped members, the nozzle plate, or the wall surface member.

5 Claims, 6 Drawing Sheets

LIQUID DISCHARGE HEAD AND IMAGE FORMING APPARATUS

BACKGROUND OF THE INVENTION

1. Field of the Invention

The disclosures herein generally relate to a liquid discharge head and an image forming apparatus.

2. Description of the Related Art

As an image forming apparatus, an apparatus adopting a liquid discharge recording method, for example, an inkjet recording apparatus, has been known that uses a recording head including, for example, a liquid discharge head (a liquid droplet discharge head) to discharge liquid droplets.

As a liquid discharge head, a head has been known that includes a passage plate formed by having multiple plate-shaped members bonded, to form an individual passage communicating with a nozzle to discharge liquid droplets (see Patent Document 1).

Also, a head has been known that reduces forced-out excessive adhesive, by narrowing a bonding part when parts constituting the head are bonded by the adhesive (see Patent Document 2).

RELATED-ART DOCUMENTS

Patent Documents

[Patent Document 1] Japanese Laid-open Patent Publication No. 2014-054816

[Patent Document 2] Japanese Laid-open Patent Publication No. 05-330065

Incidentally, for example, if the passage plate is formed with three plate-shaped members stacked and bonded by an adhesive, and the plate-shaped members are bonded to the nozzle plate and a wall surface member by the adhesive, fillets are formed by the forced-out adhesive between the plate-shaped members, and the nozzle plate and the wall surface member.

However, virtually no fillets are generated at a bonding part between separation wall parts that form separation walls between individual liquid chambers formed by multiple plate-shaped members constituting the passage plate.

Therefore, there is a problem that the bond strength of the separation wall parts is reduced only at a center portion in the stacking direction of the multiple plate-shaped members, and hence, the liquid chamber rigidity is reduced. Also, there is a problem that the multiple plate-shaped members tend to deform, and the plate-shaped members are strongly affected by the deformation at the center portion in the stacking direction.

SUMMARY OF THE INVENTION

In the view of these problems, it is a general object of at least one embodiment of the present invention to raise the bond strength when forming a passage plate by stacking and bonding multiple plate-shaped members, to raise the liquid chamber rigidity.

According to an embodiment of the present invention, a liquid discharge head includes a nozzle plate configured to have a plurality of nozzles arrayed to discharge liquid droplets; a passage plate configured to form individual liquid chambers communicating with the respective nozzles; and a wall surface member configured to form a wall surface of the individual liquid chambers. The passage plate is formed with at least three plate-shaped members stacked and bonded by an adhesive. The nozzle plate and one of the plate-shaped members of the passage plate are bonded by the adhesive, and another of the plate-shaped members of the passage plate, and the wall surface member are bonded by the adhesive. The three plate-shaped members include separation wall parts forming separation walls between the individual liquid chambers. At least one of the three plate-shaped members has a separation wall width as a width in a nozzle arrangement direction of the separation wall part, different from a separation wall width of the other plate-shaped members. Fillets of the adhesive are formed between the wall surface of the separation wall part of the plate-shaped member whose separation wall width is relatively narrow, and a bonded surface of the plate-shaped member whose separation wall width is relatively wide, between the nozzle plate and the wall surface of the separation wall part of the plate-shaped member, and between the wall surface member and the wall surface of the separation wall part of the plate-shaped member, in a direction along the nozzle arrangement direction.

According to an embodiment of the present invention, it is possible to raise the bond strength when forming a passage plate by stacking and bonding multiple plate-shaped members, to raise the liquid chamber rigidity.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
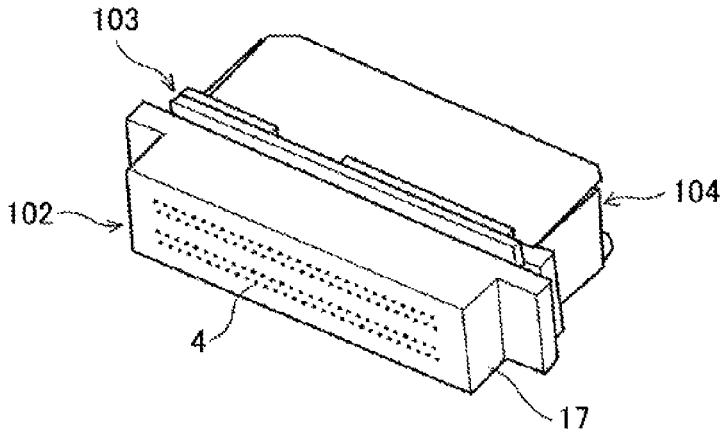
FIG. 1 is an external perspective view that illustrates an example of a head unit including a liquid discharge head according to an embodiment of the present invention.
Figure 2:
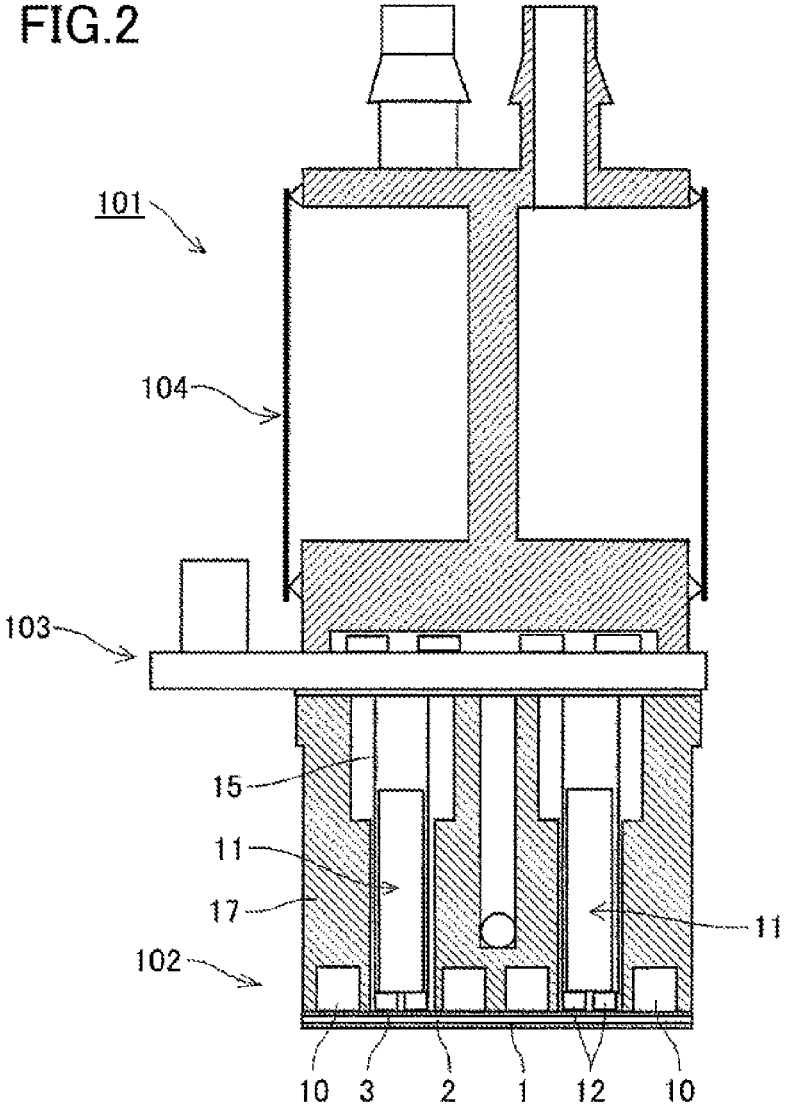
FIG. 2 is a cross-sectional view that illustrates the head unit.

In the following, embodiments of the present invention will be described with reference to the drawings. A head unit including a liquid discharge head will be described according to an embodiment of the present invention with reference to FIG. 1 and FIG. 2. FIG. 1 is an external perspective view of the head unit, and FIG. 2 is a cross-sectional view of the same.

This head unit 101 integrates a liquid discharge head 102 to discharge liquid droplets, which will be described later in the following embodiments, an electric circuit board 103 having electronic devices mounted that are connected with the liquid discharge head 102, and a tank 104 to contain liquid to be supplied to the liquid discharge head 102.

Figure 3:
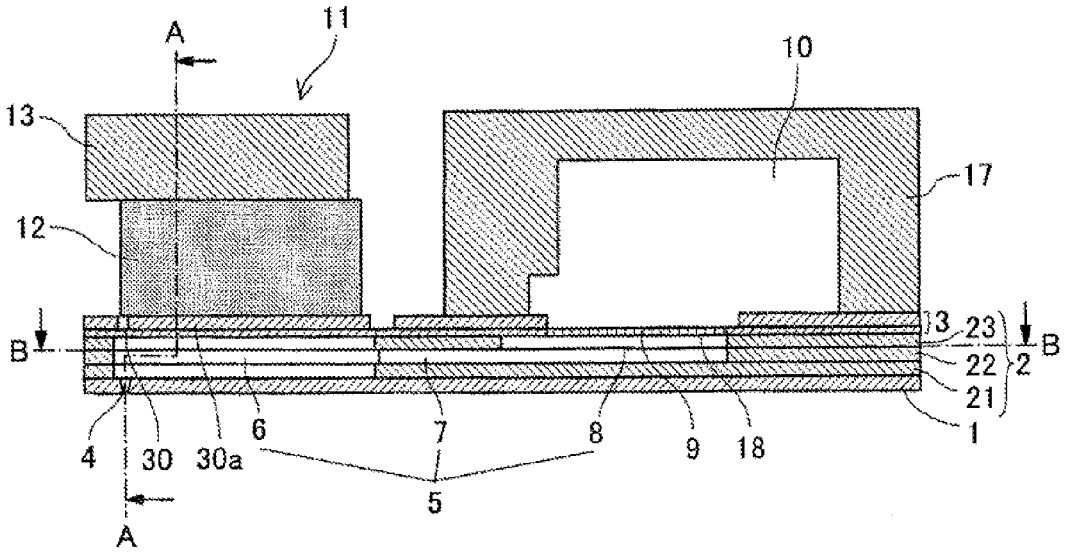
FIG. 3 is a cross-sectional view of a liquid discharge head in a direction perpendicular to the nozzle arrangement direction (the longitudinal direction of an individual liquid chamber) according to a first embodiment of the present invention.
Figure 4:
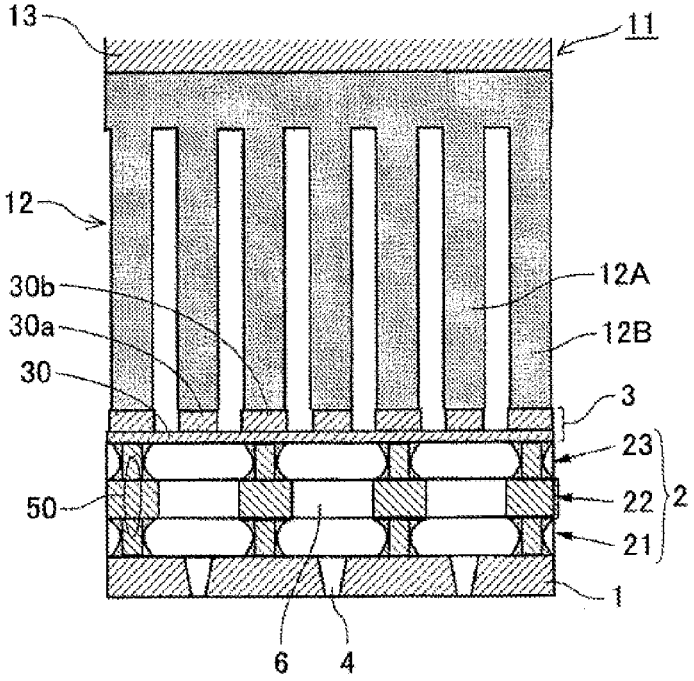
FIG. 4 is a cross-sectional view of a liquid discharge head in the nozzle arrangement direction (the lateral direction of an individual liquid chamber) taken along the line A-A in FIG. 3.
Figure 5:
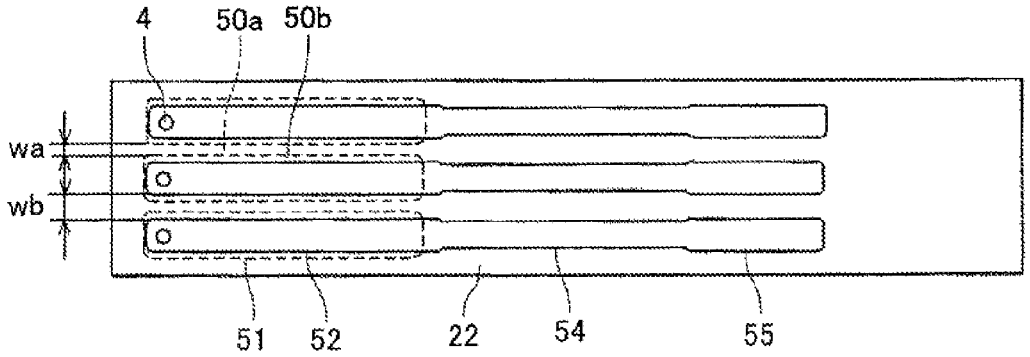
FIG. 5 is a plane view taken along the line B-B in FIG. 3.

Next, a liquid discharge head will be described according to a first embodiment of the present invention with reference to FIG. 3 to FIG. 5. FIG. 3 is a cross-sectional view of the liquid discharge head in a direction perpendicular to the nozzle arrangement direction (the longitudinal direction of an individual liquid chamber), FIG. 4 is a cross-sectional view of the liquid discharge head in the nozzle arrangement direction (the lateral direction of an individual liquid chamber) taken along the line A-A in FIG. 3, and FIG. 5 is a plane view taken along the line B-B in FIG. 3.

This liquid discharge head has a nozzle plate 1, a passage plate 2, and a vibration plate member 3 as a wall surface member stacked and bonded. In addition, the liquid discharge head includes a piezoelectric actuator 11 to displace the vibration plate member 3, and a frame member 17 as a common liquid chamber member.

The nozzle plate 1, the passage plate 2, and the vibration plate member 3 form individual passages 5 communicating with multiple nozzles 4 to discharge liquid droplets, and a common liquid chamber 18 on the downstream side of a filter 9.

Taking the side on which the nozzles 4 are disposed as the downstream side, an individual passage 5 is configured to have an individual liquid chamber 6 communicating with a nozzle 4 on the downstream side, and a fluid resistant part 7 and a liquid introduction part 8 that form a liquid supply path to supply liquid to the individual liquid chamber 6. The individual passages 5 are separated from each other by separation walls 50 between the individual liquid chambers 6 in the nozzle arrangement direction.

Also, the common liquid chamber 18 on the downstream side of the filter 9 is an opening provided for the multiple individual passages 5 arranged in the nozzle arrangement direction.

Liquid flows into the common liquid chamber 18 on the downstream side of the filter 9, from the common liquid chamber 10 of the frame member 17, through the filter part 9 that is an inlet part formed on the vibration plate member 3. The liquid is introduced into the liquid introduction part 8 from the common liquid chamber 18 on the downstream side of the filter 9, and then, supplied to the individual liquid chamber 6 from the liquid introduction part 8 via the fluid resistant part 7.

Note that the nozzle plate 1 is formed of a metal plate made of nickel (Ni), and is manufactured by an electroforming method. The plate is not limited to be made of nickel, but another metal member, a resin member, or a stacked member of a resin layer and a metal layer can be used for it. The nozzle plate 1 has the nozzles 4 formed that correspond to the individual liquid chambers 6, and is bonded to the passage plate 2 by an adhesive. Also, this nozzle plate 1 has a liquid repellent layer on the surface from which liquid droplets are discharged (the surface in the discharge direction, or the surface on the reverse side of the individual liquid chambers 6).

As will be described later in detail, the passage plate 2 has multiple (three in the present embodiment) plate-shaped members 21, 22, and 23 stacked and bonded, to form the individual liquid chambers 6, the fluid resistant parts 7, and the liquid introduction parts 8 constituting the individual passages 5, and through holes to form the common liquid chamber 18 on the downstream side of the filter 9 (a concavity may be formed in some cases).

The vibration plate member 3 is a wall surface member to form a wall surface of the individual passages 5 of the passage plate 2. This vibration plate member 3 has a two-layer structure. The first layer is positioned on the side of the passage plate 2, and on the first layer, deformable vibration areas 30 are formed at areas corresponding to the individual liquid chambers 6.

This vibration plate member 3 is formed of a metal plate made of nickel (Ni), and is manufactured by an electroforming method. The plate is not limited to be made of nickel, but another metal member, a resin member, or a stacked member of a resin layer and a metal layer can be used for it.

On the side of this vibration plate member reverse to the side facing the individual liquid chamber 6, a piezoelectric actuator 11 is placed that includes an elelectromechanical transducer as a drive unit (an actuator unit or a pressure generation unit) to deform the vibration areas 30 of the vibration plate member 3.

This piezoelectric actuator 11 includes multiple laminated piezoelectric members 12 that are bonded by an adhesive on a base member 13. The piezoelectric members 12 have half-cut dicing applied to have grooves, to form a predetermined number of pectinate, piezoelectric pillars 12A and 12B at predetermined intervals for each of the piezoelectric members 12.

Although the piezoelectric pillars 12A and 12B of the piezoelectric member 12 are the same, they are distinguished by different codes where a piezoelectric pillar driven by a given drive waveform is referred to as the drive piezoelectric pillar (drive pillar) 12A, and a piezoelectric pillar not given a drive waveform and simply used as a pillar is referred to as the non-drive piezoelectric pillar (non-drive pillar) 12B.

A drive pillar 12A is bonded to a convex part 30*a* that is an island-shaped thick part formed on the vibration area 30 of the vibration plate member 3. Also, a non-drive pillar 12B is bonded to a convex part 30*b* that is a thick part on the vibration plate member 3.

This piezoelectric member 12 has piezoelectric layers and internal electrodes stacked alternately. The internal electrodes are drawn out on edge surfaces, respectively, to form an external electrode. To send a drive signal to the external electrode of the drive pillar 12A, a flexible printed circuit board having flexibility, or an FPC 15 (see FIG. 2) is connected.

Note that since the piezoelectric actuator 11 is used here, the wall surface member is formed by the vibration plate member 3. However, if using a thermal actuator, the actuator substrate having electrothermal transducers placed forms the wall surface member.

The frame member 17 is made of stainless, and formed by a mechanical process, in which the common liquid chamber 10 is formed and to which liquid is supplied from the tank 104 described above.

In the liquid discharge head configured in this way, for example, by lowering the voltage applied to the drive pillars 12A from a reference potential, the drive pillars 12A contract, and the vibration areas 30 of the vibration plate member 3 fall to expand the capacity of the individual liquid chambers 6. This makes liquid flow into the individual liquid chambers 6.

After that, by raising the voltage applied to the drive pillars 12A to expand the drive pillars 12A in the stacking direction, the vibration areas 30 of the vibration plate member 3 are deformed in the direction toward the nozzles 4, and the capacity of the individual liquid chambers 6 is contracted. This applies pressure to the liquid in the individual liquid chambers 6, to discharge (jet out) liquid droplets from the nozzles 4.

Then, by returning the voltage applied to the drive pillars 12A to the reference potential, the vibration areas 30 of the vibration plate member 3 resume the initial positions, and the individual liquid chambers 6 expand to generate negative pressure. This makes liquid from the common liquid chamber 10 fill the individual liquid chambers 6. Then, after having vibration of the meniscus surfaces of the nozzles 4 damped to be stable, the operation is transitioned to discharging liquid droplets for the next time.

Note that the drive method of the head is not limited to the above example (discharging by pull-push), but depending on a drive waveform to be given, it is possible to execute discharging by pull, or discharging by push.

Figure 6:
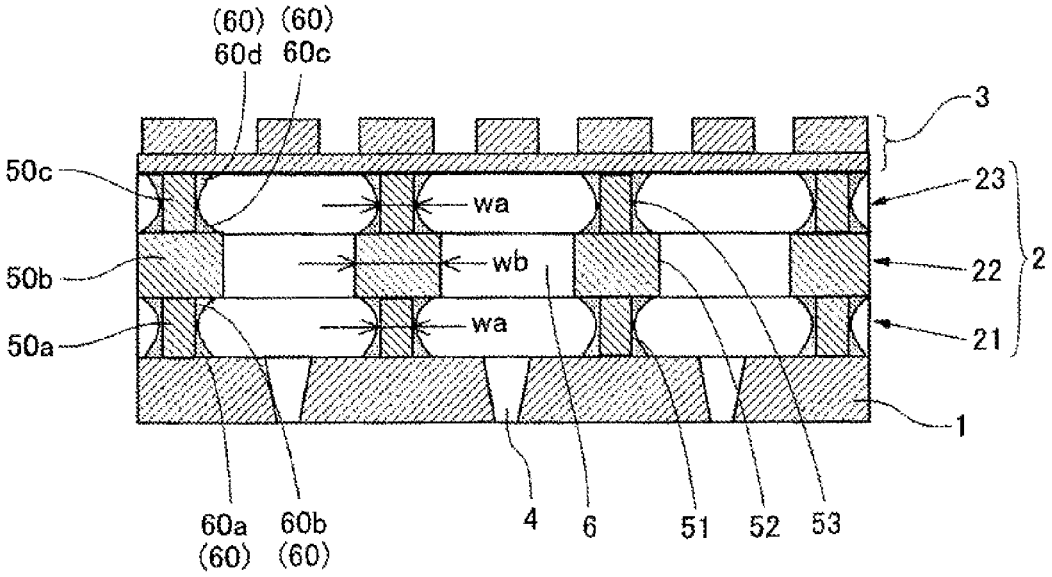
FIG. 6 is a cross-sectional view that illustrates a part corresponding to a passage unit.

Next, a part of a passage unit including the passage plate in the present embodiment will be described in detail with reference to FIG. 6. FIG. 6 is a cross-sectional view of a part of the passage unit.

As described above, the passage plate 2 is configured to have an odd number of, or three plate-shaped members 21 to 23 stacked and bonded. Note that "configured to have stacked and bonded" is not limited to a configuration obtained by forming an independent passage plate 2, and then, bonding it to the nozzle plate 1 and the wall surface member. Namely, "configured to have stacked and bonded" means to include stacked, bonded, multiple plate-shaped members obtained as a result of bonding the nozzle plate 1 to a plate-shaped member, bonding the wall surface member to a plate-shaped member, and then, bonding these to an intermediate plate-shaped member on the respective sides.

The plate-shaped member 21 is a plate-shaped member bonded to the nozzle plate 1, the plate-shaped member 23 is a plate-shaped member bonded to the wall surface member or the vibration plate member 3, and the plate-shaped member 22 is an intermediate plate-shaped member bonded between the plate-shaped member 21 and the plate-shaped member 23.

The plate-shaped member 21 has through holes 51 formed to form the individual liquid chambers 6, the plate-shaped member 22 has through holes 52 formed to form the individual liquid chambers 6, and the plate-shaped member 23 has through holes 53 formed to form the individual liquid chambers 6.

Note that the plate-shaped member 22 also has through holes 54 formed to form the fluid resistant parts 7 communicating with the through holes 52 to form the individual liquid chambers 6, and has through holes 55 formed to form the liquid introduction parts 8. By putting the plate-shaped member 22 between the plate-shaped members 21 and 23, the fluid resistant parts 7 are formed by the through holes 53.

Here, the width wa of the separation wall parts 50*a* and 50*c*, which constitute the separation walls 50 of the plate-shaped member 21 and the plate-shaped member 23 between the individual liquid chambers 6, in the nozzle arrangement direction (referred to as the "separation wall width" below) is formed to be narrower than the separation wall width wb of the separation wall parts 50*b* of the plate-shaped member 22, which also constitutes the separation walls 50 between the individual liquid chambers 6.

In other words, the width of the through holes 51 and 53 of the plate-shaped member 21 and the plate-shaped member 23 that constitute the individual liquid chambers 6, are formed to be wider than the width of the through holes 52 of the plate-shaped member 22 that also constitutes the individual liquid chambers 6.

Namely, the passage plate 2 is formed by an odd number of the plate-shaped members 21 to 23, and the separation wall width wa of the plate-shaped members 21 and 23 that are odd-numbered (first and third) counting from the nozzle plate 1 side, is narrower than the separation wall width wb of the even-numbered (second) plate-shaped member 22.

Configured in this way, steps are formed on the separation walls 50 between the individual liquid chambers 6, by the wall surfaces of the separation wall parts 50*a* and 50*c* of the plate-shaped members 21 and 23, the wall surfaces of the separation wall parts 50*b* of the plate-shaped member 22, and the bonded surfaces the separation wall parts 50*b* of the plate-shaped member 22.

Here, the nozzle plate 1 and the plate-shaped member 21, the plate-shaped members 21 and 22, the plate-shaped members 22 and 23, and the plate-shaped member 23 and the vibration plate member 3 are bonded by the adhesive, respectively.

Consequently, the fillets 60*a* are formed by the forced-out adhesive between the nozzle plate 1 and the wall surfaces of the separation walls part 50*a* of the plate-shaped member 21. Also, the fillets 60*b* are formed by the forced-out adhesive between the wall surfaces of the separation wall parts 50*a* of the plate-shaped member 21, and the bonded surfaces of the separation wall parts 50*b* of the plate-shaped member 22. Also, the fillets 60*c* are formed by the forced-out adhesive between the bonded surfaces of the separation wall parts 50*b* of the plate-shaped member 22, and the wall surfaces of the separation wall parts 50*c* of the plate-shaped member 23. Also, the fillets 60*d* are formed by the forced-out adhesive between the wall surfaces of the separation walls part 50*c* of the plate-shaped member 23, and the vibration plate member 3.

In this way, the fillets 60 are formed not only between the passage plate 2, the nozzle plate 1, and the vibration plate member 3, but also between the plate-shaped members 21, 22, and 23. Therefore, the bond strength is raised by forming the passage plate by having multiple plate-shaped members stacked and bonded, and hence, the liquid chamber rigidity can be raised.

In this case, the fillets 60*a* to 60*d* are formed so that their cross-sectional shapes in the nozzle arrangement direction are virtually the same.

Next, an assembly process of these members will be described specifically.

The nozzle plate 1, the plate-shaped members 21, 22, and 23, and the vibration plate member 3 are bonded by the adhesive to form a passage unit.

First, the nozzle plate 1 and the plate-shaped member 21 are bonded to each other by the adhesive 60. The adhesive 60 is of one component, and is applied to the plate-shaped member 21 by a spray, which is then heated in a pressurized state to be bonded.

Note that an application amount of the adhesive 60 is determined by the width of the fillet 60*a* to be obtained after the bonding. Denoting a target value of the fillet width after the bonding by wr, wr=(wa+wb)/2 where wa represents the separation wall width of the separation wall parts 50*a* and 50*c* of the plate-shaped members 21 and 23, and wb represents the separation wall width of the separation wall parts 50*b* of the plate-shaped member 22. An application amount that results in the fillet width wr is determined by an experiment.

Next, the plate-shaped member 23 and the vibration plate member 3 are bonded to each other by the adhesive 60. This bonding is also done by applying the adhesive 60 to the plate-shaped member 23 by the spray. The application amount is determined by the same method used for the nozzle plate 1 and the plate-shaped member 21 described above.

Next, a combined plate of the nozzle plate and the plate-shaped member 21, and a combined plate of the plate-shaped member 23 and the vibration plate member 3, are bonded to respectively surfaces of the plate-shaped member 22. This bonding is done by applying the adhesive 60 to both surfaces of the plate-shaped member 22. The application amount is determined by the same method used for the nozzle plate 1 and the plate-shaped member 21. In this case, however, the condition is extracted for each of the surfaces.

Note that the passage unit is bonded to the piezoelectric actuator 11 by the adhesive.

The bonding for the above configuration generates the fillets 60*b* of the adhesive 60 because the separation wall width wb of the plate-shaped member 22 is relatively wider than the separation wall width wa of the plate-shaped member 21. The projection amount of the separation wall part 50*b* on the plate-shaped member 22 toward the individual liquid chamber 6 is set longer that the distance from the separation wall part 50*c* of the plate-shaped member 23 to the vibration area 30 of the vibration plate member 3. This is because it is necessary to prevent the adhesive 60 from flowing out to reach the vibration area 30 for the bonding between the vibration plate member 3 and the plate-shaped member 23.

Therefore, the fillets 60*b* and 60*c* generated on the separation wall parts 50*b* of the plate-shaped member 22 have the same width in the nozzle arrangement direction as the width of the fillets 60*d* generated between the vibration plate member 3 and the plate-shaped member 23. Also, the fillets 60*a* generated at the bonding between the nozzle plate 1 and the plate-shaped member 21 have the same width because the plate-shaped member 21 and the plate-shaped member 23 have the same separation wall width.

Thus, the uniform fillets 60*a* to 60*d* are formed for all bonding.

Configured in this way, differences of the bond strengths are reduced among the stacked plate-shaped members, and a highly reliable head can be obtained. Also, by having the bond strength improved, the crosstalk performance is improved, and a head having less fluctuation of droplet speed can be obtained irrespective of the number of drive channels (the number of simultaneously driven nozzles).

Figure 7:
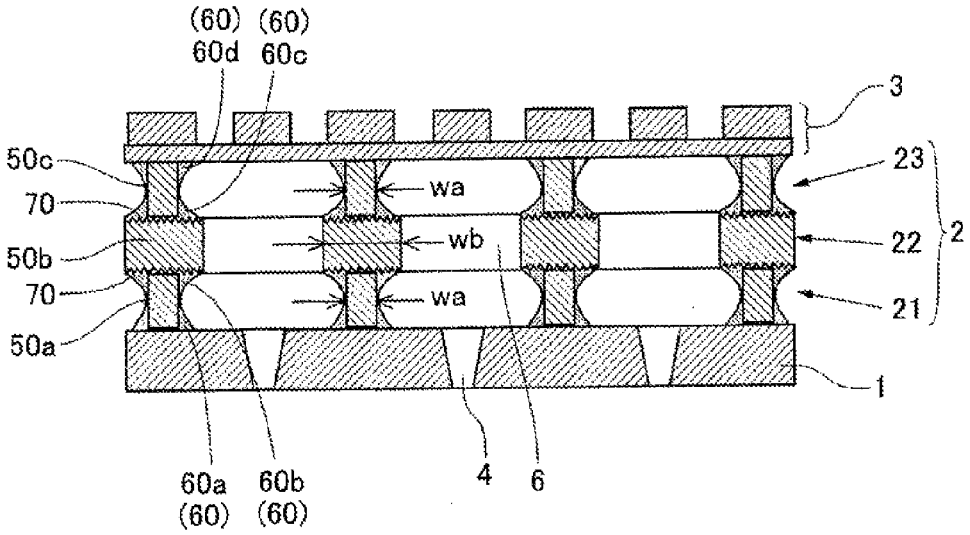
FIG. 7 is a cross-sectional view that illustrates a part corresponding to a passage unit of a liquid discharge head according to a second embodiment of the present invention.

Next, a liquid discharge head will be described according to a second embodiment of the present invention with reference to FIG. 7. FIG. 7 is a cross-sectional view that illustrates a part of a passage unit of the liquid discharge head.

In the present embodiment, a roughening process (a process to roughen a surface) is applied to surfaces to be bonded of an intermediate plate-shaped member 22 to obtain the rough surfaces 70.

Configured in this way, the rough surfaces 70 have an anchor effect to the adhesive 60, with which the bond strength can be further raised between the plate-shaped member 22 and the plate-shaped members 21 and 23.

Figure 8:
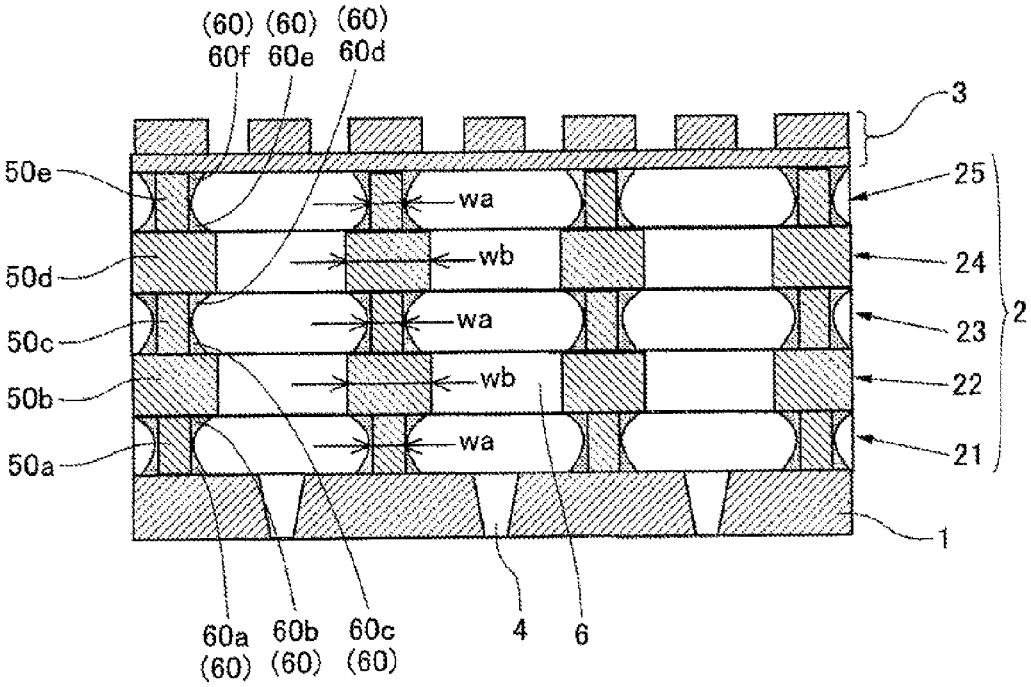
FIG. 8 is a cross-sectional view that illustrates a part corresponding to a passage unit of a liquid discharge head according to a third embodiment of the present invention.

Next, a liquid discharge head will be described according to a third embodiment of the present invention with reference to FIG. 8. FIG. 8 is a cross-sectional view that illustrates a part of a passage unit of the liquid discharge head.

In the present embodiment, an odd number of, or five plate-shaped members 21 to 25 are stacked and bonded to form the passage plate 2. The five plate-shaped members 21 to 25 have through holes formed to form the individual liquid chambers 6, and the separation wall parts 50*a* to 50*e* to form separation walls 50 between the individual liquid chambers 6.

A nozzle plate 1 is bonded to the plate-shaped member 21, and a wall surface member or a vibration plate member 3 is bonded to the plate-shaped member 25.

In addition, the separation wall width wa of the plate-shaped members 21, 23, and 25 that are odd-numbered (first, third, and fifth) counting from the nozzle plate 1 side, is configured to be narrower than the separation wall width wb of the even-numbered (second and fourth) plate-shaped members 22 and 24.

Configured in this way, even though the heights of the individual liquid chambers 6 are higher due to this multi-layer structure, the bond strength can be secured.

Figure 9:
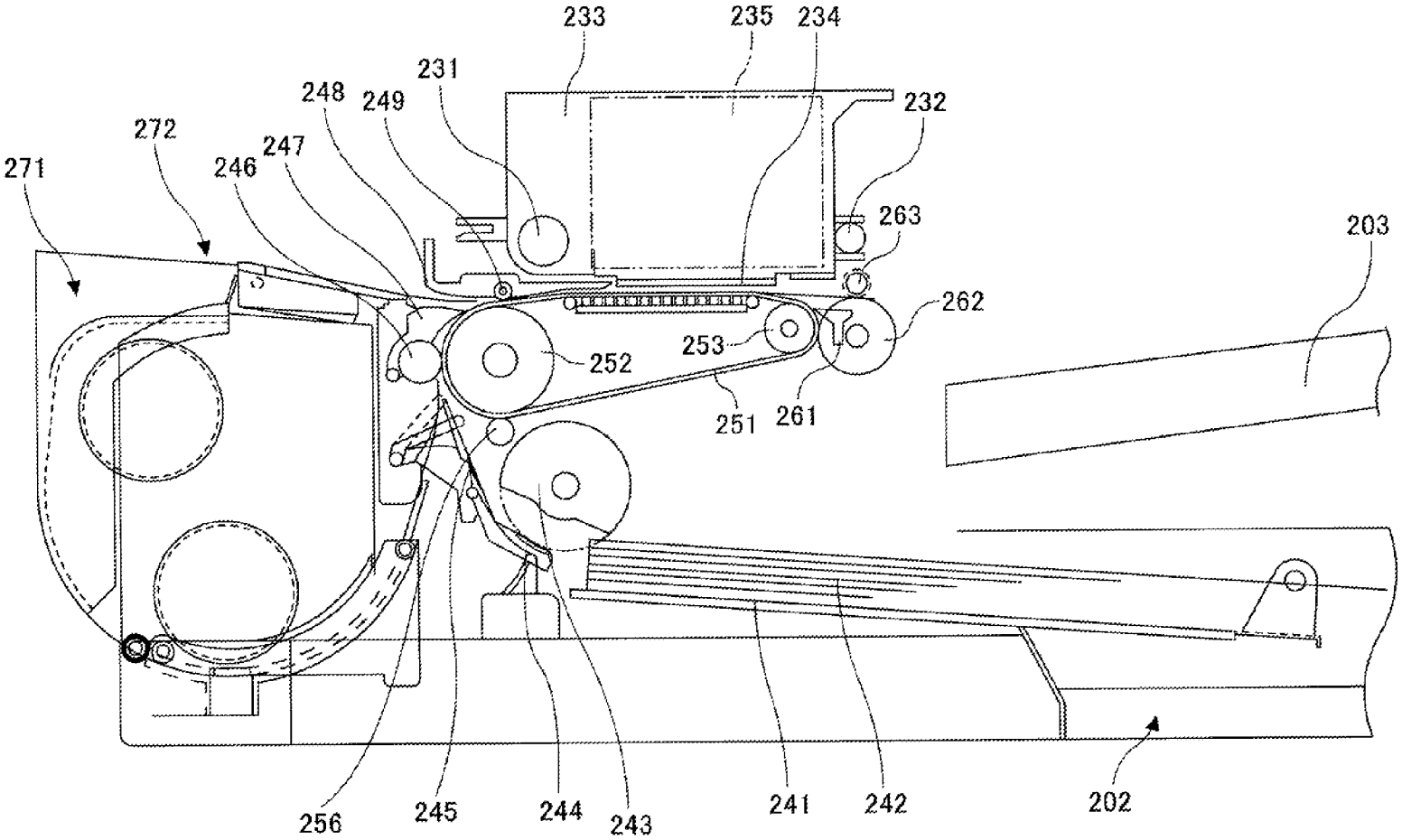
FIG. 9 is a side view that illustrates an example of a mechanical part of an image forming apparatus according to an embodiment of the present invention.
Figure 10:
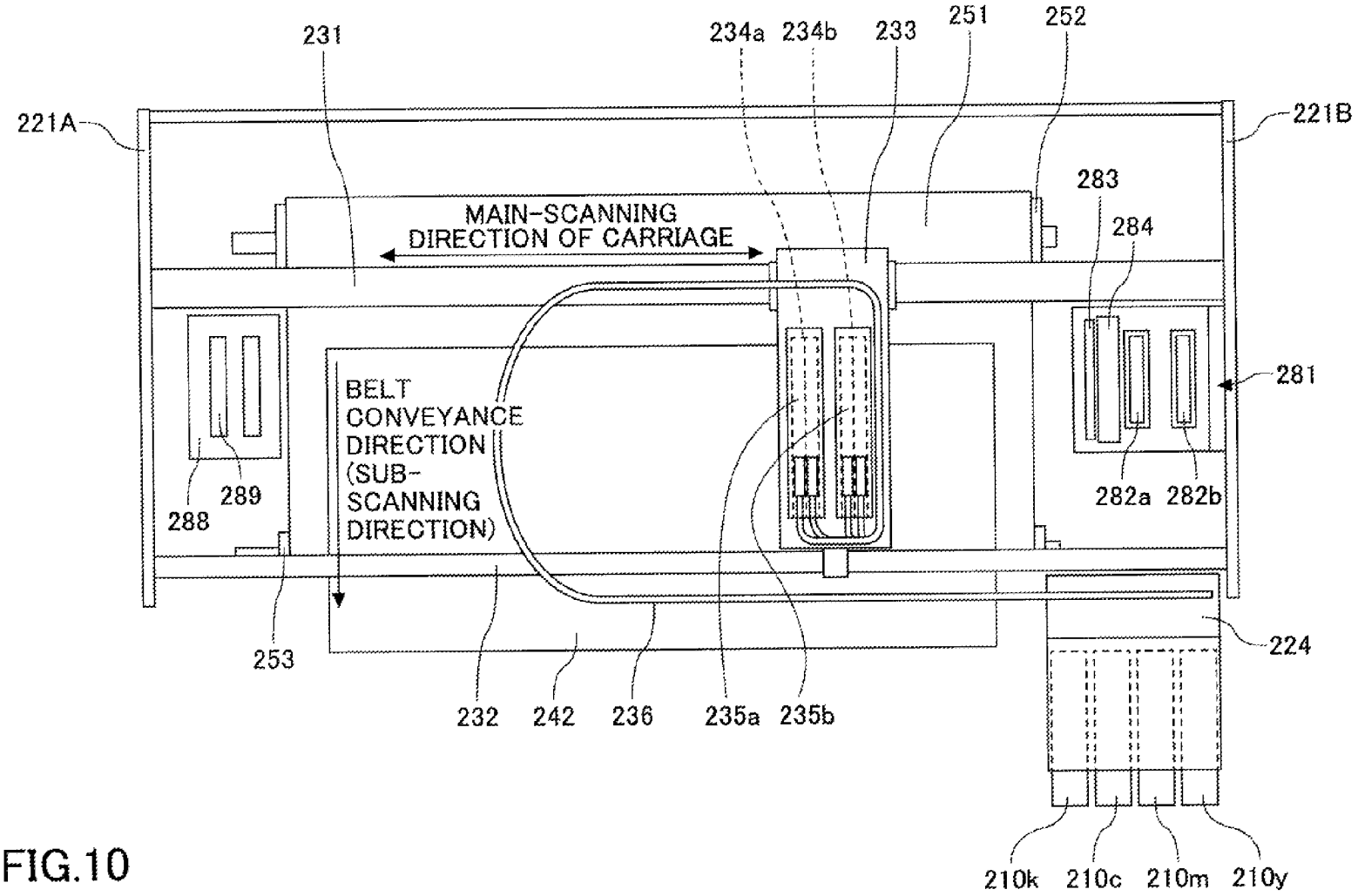
FIG. 10 is a plane view that illustrates a core part of the mechanical part.

Next, an example of an image forming apparatus will be described that includes a liquid discharge head according to the embodiments of the present invention with reference to FIG. 9 and FIG. 10. FIG. 9 is a side view that illustrates a mechanical part of the image forming apparatus, and FIG. 10 is a plane view that illustrates a core part of the mechanical part.

The image forming apparatus is a serial-type image forming apparatus, and holds a carriage 233 by main and sub guide rods 231 and 232 that are guide members to make the carriage 233 slidable in a main scanning direction, and are also lateral bridging parts between left and right side plates 221A and 221B. Also, a main scanning motor (not illustrated) is provided to move the carriage 233 for scanning via a timing belt in a direction designated by an arrow (main scanning direction of the carriage).

The carriage 233 has two recording heads 234*a* and 234*b* (referred to as the "recording head(s) 234" if distinction is not needed below, and the same for the other members) mounted that include liquid discharge heads to discharge ink droplets of several colors. The recording head 234 has an array of multiple nozzles arranged in a sub-scanning direction, which is perpendicular to the main scanning direction, and has its surface for discharging ink droplets directed downward.

Here, each of the recording heads 234 includes the liquid discharge head having two lines of nozzles. One recording head 234*a* has a line of nozzles discharging black (K) droplets, and the other line of nozzles discharging cyan (C) droplets. The other recording head 234*b* has a line of nozzles discharging magenta (M) droplets, and the other of nozzles discharging yellow (Y) droplets. Note that although the configuration here has two heads for discharging liquid droplets of four colors, liquid discharge heads may be provided for the colors, respectively.

The carriage 233 also has sub tanks 235 attached to supply ink of corresponding colors to the lines of nozzles of the recording head 234. Ink of the corresponding colors is supplied to the sub tanks 29 from ink cartridges 210 of the corresponding colors by the supply units 224 via supply tubes 236 of the corresponding colors.

On the other hand, as a sheet feeding part to feed sheets 242 loaded on a sheet loading part (pressure plate) 241 of a sheet feeding tray 202, the mechanical part includes a semicircular roller (a sheet feeding roller) 243 to separate and feed the sheets 242 from the sheet loading section 241 one by one, and a separation pad 244 facing the sheet feeding roller 243.

Then, to convey the sheet 242 fed by the sheet feeding part, below the recording head 234, the mechanical part includes a guide 245 to guide the sheet 242, a counter roller 246, a conveyance guide member 247, and a pressing member 248 having a tip-pressing roller 249. Further, the mechanical part includes a conveyance belt 251 that is a conveyance unit to attract the conveyed sheet 242 electrostatically, and to convey it to a position facing the recording head 234.

This conveyance belt 251 is an endless belt, and configured to be wrapped around and stretched between a conveying roller 252 and a tension roller 253, to rotate in a belt conveyance direction (the sub-scanning direction). Also, the mechanical part includes a charging roller 256 as a charging unit to charge the surface of this conveyance belt 251. This charging roller 256 is disposed to contact the surface layer of the conveyance belt 251, and to rotate depending on rotary movement of the conveyance belt 251. This conveyance belt 251 moves rotationally in the belt conveying direction when the conveying roller 252 is driven to rotate by a sub-scanning motor (not illustrated) via a timing belt.

Further, as a sheet ejecting part to eject the sheet 242 having recorded by the recording head 234, the mechanical part includes a separation claw 261 to separate the sheet 242 from the conveyance belt 251, a sheet ejection roller 262 and a sheet ejection roller 263, and a sheet ejection tray 203 under the sheet ejection roller 262.

Also, on a back part of the main body of the apparatus, a duplex unit 271 is provided that can be easily attached or detached. This duplex unit 271 takes in the sheet 242 that has returned by reverse directional rotation of the conveyance belt 251, flips of the sheet 242, and feeds the sheet 242 again into a nip between the counter roller 246 and the conveyance belt 251. Also, a manual feed tray 272 is set on the top surface of the duplex unit 271.

Further, in a non-printing area at one end in the main scanning direction of the carriage 233, a maintenance and recovery mechanism 281 is provided to maintain and recover a state of the nozzles of the recording head 234.

The maintenance and recovery mechanism 281 includes cap members (referred to as "caps" below) 282*a* and 282*b* (referred to as the "cap(s)" 282 if distinction is not required) for capping the nozzle surfaces of the recording head 234. The maintenance and recovery mechanism 281 also includes a wiper blade 283, which is a blade member to wipe the nozzle surfaces. The maintenance and recovery mechanism 281 also includes a blank discharge receiver 284 to receive liquid droplets when blank discharging is executed to discharge liquid droplets, not for contributing to the recording, but for discarding recording liquid having increased viscosity.

Also, in a non-printing area at the other end in the main scanning direction of the carriage 233, a blank discharge receiver 288 is disposed to receive liquid droplets when blank discharging is executed to discharge liquid droplets, not for contributing to the recording, but for discarding recording liquid having increased viscosity during the recording or the like. This blank discharge receiver 288 includes an opening 289 along the lines of nozzles of the recording head 234.

In this image forming apparatus configured in this way, the sheets 242 are separated and fed from the sheet feed tray 202 one by one. The sheet 242 fed and turned in a virtually vertical up direction is guided through the guide 245, and is conveyed through a nip between the conveyance belt 251 and the counter roller 246. Further, the sheet 242 has its tip guided by a conveyance guide (not illustrated), to be pressed on the conveyance belt 251 by the tip-pressing roller 249, and the conveyance direction is turned by about 90°.

Then, when the sheet 242 is conveyed on the charged conveyance belt 251, the sheet 242 is attracted by the conveyance belt 251, and conveyed in the sub-scanning direction by rotational movement of the conveyance belt 251.

While having the carriage 233 move, the image forming apparatus drives the recording head 24 in response to image signals, to discharges ink droplets onto the suspended sheet 242 to record a line of image data, then conveys the sheet 242 by a predetermined length, and executes recording the next line. When receiving a signal indicating the end of recording, or a signal indicating that the rear end of the sheet 242 has reached the recording area, the image forming apparatus ends the recording operation, and ejects the sheet 242 to the sheet ejection tray 203.

Thus, this image forming apparatus includes a liquid discharge head according to one of the embodiments of the present invention as the recording head, and hence, can stably form images having high picture quality.

Note that in the present invention, a medium to be recorded on, a recording medium, recording paper, and a recording sheet are treated as synonyms. Also, image forming, recording, character printing, photo printing, and printing are treated as synonyms.

Also, an "image forming apparatus" means an apparatus to form an image by discharging liquid onto media such as paper, strings, fiber, cloth, leather, metals, plastic, glass, wood, ceramics and the like. Also, "image forming" means not only to form images having meanings such as characters, figures and the like onto a medium, but to form images without patterns or meanings onto a medium, such as just discharging droplets onto a medium.

Also, if not especially specified, "ink" is not limited to so-called ink, but the term "ink" is used as a generic term to mean any kind of liquid which can be used for image forming such as recording liquid, fixing liquid, liquid and the like. "Ink" may include, for example, DNA samples, photoresist, patterning material, resin and the like.

Also, an "image" is not limited to a planar image, but includes an image formed on a three dimensional object, and a solid body formed three dimensionally.

Also, if not especially specified, an image forming apparatus may be either of a serial-type image forming apparatus or a line-type image forming apparatus.

Also, the pressure generation unit is not limited to a piezoelectric actuator, but may be a thermal actuator that uses an electrothermal transducer such as a thermal resistance element, or an electrostatic actuator including a vibration plate and facing electrodes.

Further, the present invention is not limited to these embodiments, but various variations and modifications may be made without departing from the scope of the present invention.

The present application is based on and claims the benefit of priority of Japanese Priority Application No. 2014-189543 filed on Sep. 18, 2014, with the Japanese Patent Office, the entire contents of which are hereby incorporated by reference.

What is claimed is:

1. A liquid discharge head, comprising:

a nozzle plate configured to have a plurality of nozzles arrayed to discharge liquid droplets;

a passage plate configured to form individual liquid chambers communicating with the respective nozzles; and a wall surface member configured to form a wall surface of the individual liquid chambers, wherein the passage plate is formed with at least three plate-shaped members stacked and bonded by an adhesive, wherein the nozzle plate and one of the plate-shaped members of the passage plate are bonded by the adhesive, and another of the plate-shaped members of the passage plate, and the wall surface member are bonded by the adhesive, wherein the three plate-shaped members include separation wall parts foil ling separation walls between the individual liquid chambers, wherein at least one of the three plate-shaped members has a separation wall width as a width in a nozzle arrangement direction of the separation wall part, different from a separation wall width of the other plate-shaped members, wherein fillets of the adhesive are formed between the wall surface of the separation wall part of the plate-shaped member whose separation wall width is relatively narrow, and a bonded surface of the plate-shaped member whose separation wall width is relatively wide, between the nozzle plate and the wall surface of the separation wall part of the plate-shaped member, and between the wall surface member and the wall surface of the separation wall part of the plate-shaped member, in a direction along the nozzle arrangement direction, and wherein a side surface of the separation wall part whose width is relatively narrow faces an adjacent individual liquid chamber and said separation wall part whose width is relatively narrow is stacked on the bonded surface of the adjacent plate-shaped member whose separation wall width is relatively wide, and corresponding fillets of adhesive bond (i) said side surface of the separation wall part whose width is relatively narrow and (ii) the bonded surface of the adjacent plate-shaped member whose separation wall width is relatively wide.

2. The liquid discharge head, as claimed in claim 1, wherein the fillets of the adhesive formed between the wall surface of the separation wall part of the plate-shaped member whose separation wall width is relatively narrow, and the bonded surface of the plate-shaped member whose separation wall width is relatively wide, the fillets of the adhesive formed between the nozzle plate and the wall surface of the separation wall part of the plate-shaped member, and the fillets of the adhesive formed between the wall surface member and the wall surface of the separation wall part of the plate-shaped member, have substantially the same cross-sectional shapes, in the direction along the nozzle arrangement direction.

3. The liquid discharge head, as claimed in claim 1, wherein the passage plate is formed with an odd number of the plate-shaped members, wherein the separation wall width of the plate-shaped member at an odd-numbered position counting from the nozzle plate side is narrower than the separation wall width of the plate-shaped member at an even-numbered position.

4. The liquid discharge head, as claimed in claim 1, wherein a roughening process is applied to at least one of the plate-shaped members forming the passage plate, on both surfaces to be bonded to the other plate-shaped members, respectively.

5. An image forming apparatus, comprising:

the liquid discharge head, as claimed in claim 1.

* * * * *